313-414 SR
2/15/83 OR 4,374,341

United States Patent [19]

Say

[11] 4,374,341

[45] Feb. 15, 1983

[54] BEAM FOCUSING MEANS IN A UNITIZED TRI-POTENTIAL CRT ELECTRON GUN ASSEMBLY

[75] Inventor: Donald L. Say, Waterloo, N.Y.

[73] Assignee: North American Philips Consumer Electronics Corp., New York, N.Y.

[21] Appl. No.: 197,308

[22] Filed: Oct. 15, 1980

[51] Int. Cl.[3] ..... H01J 29/50; H01J 29/56

[52] U.S. Cl. ..... 313/414

[58] Field of Search ..... 313/414, 412

[56] References Cited

U.S. PATENT DOCUMENTS

| | | | |
|---|---|---|---|
| 4,086,513 | 4/1978 | Evans, Jr. | 313/414 |
| 4,208,610 | 6/1980 | Schwartz | 313/414 |
| 4,275,332 | 6/1981 | Ashizaki et al. | 313/414 |

FOREIGN PATENT DOCUMENTS

| | | | |
|---|---|---|---|
| 52-51863 | 4/1977 | Japan | 313/412 |
| 54-13769 | 2/1979 | Japan | 313/414 |

*Primary Examiner*—Palmer C. Demeo
*Attorney, Agent, or Firm*—Thomas A. Briody; Jack Oisher; John C. Fox

[57] ABSTRACT

Means for achieving improved focusing of shaped electron beams are introduced into the low focusing electrode member of the multi-electrode distributed focusing lens of at least one of the gun structures in a CRT plural beam tri-potential in-line electron gun assembly. This improvement is in the form of a pair of substantially planar insert elements, one of which is horizontally positioned on either side of a forward aperture of the unitized low focusing electrode. These impart correctional influences to asymmetrics in the respective lensing field, and aid in alleviating subsequent spherical aberration of the shaped beam, thereby achieving a desired circular beam spot landing at the center of the screen.

5 Claims, 9 Drawing Figures

BEAM FOCUSING MEANS IN A UNITIZED TRI-POTENTIAL CRT ELECTRON GUN ASSEMBLY

CROSS REFERENCE TO RELATED APPLICATION

Filed concurrently with this application and assigned to the assignee of the present invention, is an application Ser. No. 197,312, which pertains to a beam focusing improvement in a CRT plural beam bi-potential in-line electron gun assembly.

TECHNICAL FIELD

This invention relates to electron guns for color cathode ray tubes (CRTs) and more particularly to means for modifying the lensing field for focusing a shaped electron beam in a unitized tri-potential (TPF) gun.

BACKGROUND OF THE INVENTION

It is conventional practice in color television and allied display applications, to utilize cathode ray tubes of the type employing a patterned multi-phosphor cathodo-luminescent screen; such being interiorly disposed on the viewing panel portion of the tube envelope, wherein an apertured or multi-opening mask member is spatially positioned relative thereto. A plurality of electron beams, emanating from an electron gun assembly encompassed within the neck portion of the tube envelope, are directed to converge at and traverse the apertured mask to thence impinge and luminescently excite the array of electron responsive phosphors comprising the patterned screen therebeyond. Focusing of the respective electron beams is conventionally achieved by discrete electron lensing means; as for example, tri-potential focus lensing, such being accomplished by a distributed focusing lens system embodying four sequential electrodes (G3), (G4), (G5), (G6) whereupon three different potentials (low, intermediate and high), are suitably applied.

The development of cathode ray tube technology has resulted in a marked trend toward miniaturization and compaction of electron gun structures, which in turn, are encompassed within envelope neck portions of smaller diameters and shorter lengths. Consequently, the dimensionings and constructions of the electrode elements of the multi-gun assemblies have been adapted to achieve the desired compaction. This is especially evident in the conventional inline plural gun assembly, wherein three separate electron beams are projected in a substantially common horizontal plane. Such is expeditiously accomplished by employing a unitized construction in which several of the respective electrode elements, ahead of the individual cathodes, are unitized electrode members of definitive construction, each having at least one plane with three spatially-related inline apertures therein.

In addition to gun assembly miniaturization, there has been wide acceptance of self-converging deflection yokes, fostered mainly by their improved performance, manufacturing efficiency and cost advantages. To more fully realize the advancements afforded by the self-converging system, the "shaped beam" concept has been introduced into electron gun construction to provide a significant improvement in deflected spot shape, thereby achieving a better focus balance between the center and corners of the screen.

The term "shaped beam", as referred to herein, is a beam or bundle of electron rays having a defined cross-sectional body configuration of a shape other than circular. In this instance, the beam, in its passage through the gun structure, is substantially of ovate shaping. The beneficially shaped beams are usually effected in the primary portion of the gun structure, for example, by the control grid (G1) and/or screen grid (G2) electrodes wherein aperture-related beam shaping configurations impart discrete cross-sectional shaping to the bundle of moving electrons passing therethrough. Exemplary art relating in general to beam shaping electrode structures is evidenced in filed U.S. patent applications Ser. No. 094,405, now U.S. Pat. No. 4,307,498, Ser. No. 094,409, now U.S. Pat. No. 4,272,700 Ser. No. 094,515 now U.S. Pat. No. 4,251,747 and Ser. No. 175,165, all of which are assigned to the assignee of the present invention.

In a unitized tri-potential in-line plural beam electron gun assembly one or all three of the undeflected focused beam spot landings at the center of the screen may be of ovate shaping. This is thought to be due to asymmetrics in the focusing field of the lensing in the gun, or to asymmetrics in the beam itself as it passes through the principal lensing region. For instance, in a TPF tube utilizing "shaped beams" to improve deflected performance, the respective beams evidence horizontally elongated cross-sectional shapings as they pass through the lensing effected within the gun structure; and upon arriving undeflected at the center of the screen, tend to exhibit ovate beam spot landing areas of substantially vertical orientation rather than the desired circular spot landings. Such focused ovate shapings appear to be the result of structural influences inherent in the unitized TPF construction which introduce asymmetrics and spherical aberration into the lengthy shaped-beam lensing fields. These accentuate overfocusing in the horizontal plane. The resultant vertically oriented beam spot landing is much more pronounced for the beam projected by the center gun, and may additionally evidence horizontal tailings extending from either side thereof. Any degree of presence of such center-of-screen abnormalities, from any or all of the guns, tends to detract from the desired picture resolution in the screen display of a TPF tube.

DISCLOSURE OF THE INVENTION

It is therefore an object of this invention to reduce and obviate the aforementioned disadvantages evidenced in the prior art. Another object of the invention is the provision of a structural modification in the tri-potential lensing region to impart a correctional influence to the focusing of the shaped beam passing therethrough, to effect a substantially circular beam spot landing at the center of the screen.

These and other objects and advantages are accomplished in one aspect of the invention by providing an improvement to that part of the lensing field associated with the low potential focusing electrode (G4), which is a unitized element having a longitudinal dimension defined between rear and forward plural apertured ends. The improvement, which relates to at least one of the forward apertures thereof, is in the form of a pair of inserts of substantially planar metallic "sideboard-like" elements oriented within the electrode (G4), in standing parallel positions, substantially perpendicular to the interior surface of the forward end thereof. These two "sideboards" are positioned one on either side of the respective forward aperture, on planes substantially parallel with the "x" axis of the gun structure, to impart a modification to the equipotential lines of the lensing system affecting the respective shaped beam in the most effective "G4–G6" area of the distributed TPF focusing lens. Such improvements added internally to the forward portion of the low focusing electrode (G4), provide beneficial influences to the TPF lensing thereby effecting a focused beam landing spot at the center of the screen that is desirably substantially circular in shape.

BEST MODE FOR CARRYING OUT THE INVENTION

For a better understanding of the present invention together with other and further objects, advantages and capabilities thereof, reference is made to the following disclosure and appended claims taken in conjunction with the aforedescribed drawings.

Figure 1:
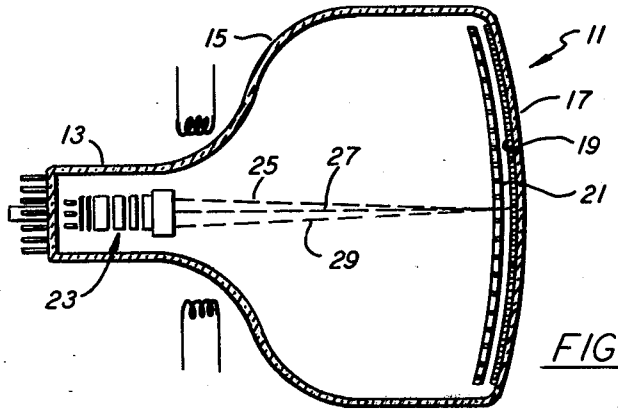
FIG. 1 is a cross-sectional view of a TPF cathode ray tube wherein the invention is utilized.

With reference to FIG. 1, the essentials of a plural in-line beam TPF color cathode ray tube construction 11 are shown in cross-section. The encompassing envelope is comprised of an integration of neck 13, funnel 15 and viewing panel 17 portions. Disposed on the interior surface of the viewing panel is a discretely patterned cathodoluminescent screen 19 formed as a repetitive array of definitive stripes or dots of color-emitting phosphor components, such being in keeping with the state of the art. A multi-opening structure 21, in this instance a shadowmask, is positioned within the viewing panel in spatial relationship to the patterned screen; such being located within the panel by conventional means, not shown.

Positionally encompassed within the envelope neck portion 13, is a unitized plural-beam in-line electron gun assembly 23, comprised of an integration of three related tri-potential gun structures. The guns in this unitized assembly form and direct three separate substantially oval shaped electron beams 25, 27 and 29 to discretely traverse the multi-opening mask 21 and impinge the patterned screen 19 therebeyond. It is within this electron gun assembly 23 that the improvement of the invention resides.

Figure 2:
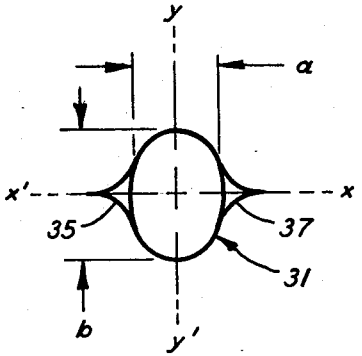
FIG. 2 Prior Art
FIG. 2 is a prior art view of an ovately-shaped beam landing spot at the center of the screen.

Because of inherent structural influences relating to compaction of electrode parameters, a unitized assembly of in-line tri-potential electron guns, having desirably oval shaped beams therein, are affected by degrees of spherical aberration which often result in focused beam landings at the center of the screen that are of ovate cross-sectional shaping instead of the desired circular shape. This abnormally shaped beam landing is much more evidenced in the focused beam from the center of the in-line guns. An exemplary center-of-screen beam spot landing area of the undesired ovate type is shown in FIG. 2 wherein the spot area 31 is oriented relative to the x-y coördinate axes of the screen 19. As such, the focused ovate landing evidences a major axis (y-y') which is oriented in substantially coincidental relationship with the vertical plane (y-y') 33 of the gun assembly 23. While the dimensional characteristics "a" and "b" of this ovate area may vary due to gun structural influences, the original shaping of the beam and the spherical aberration in the lensing are sometimes contributing factors to the formation of horizontally oriented "tailings" 35 and 37, which extend outward from either side of the landing, creating what is sometimes referred to as a "propeller effect".

Figure 3:
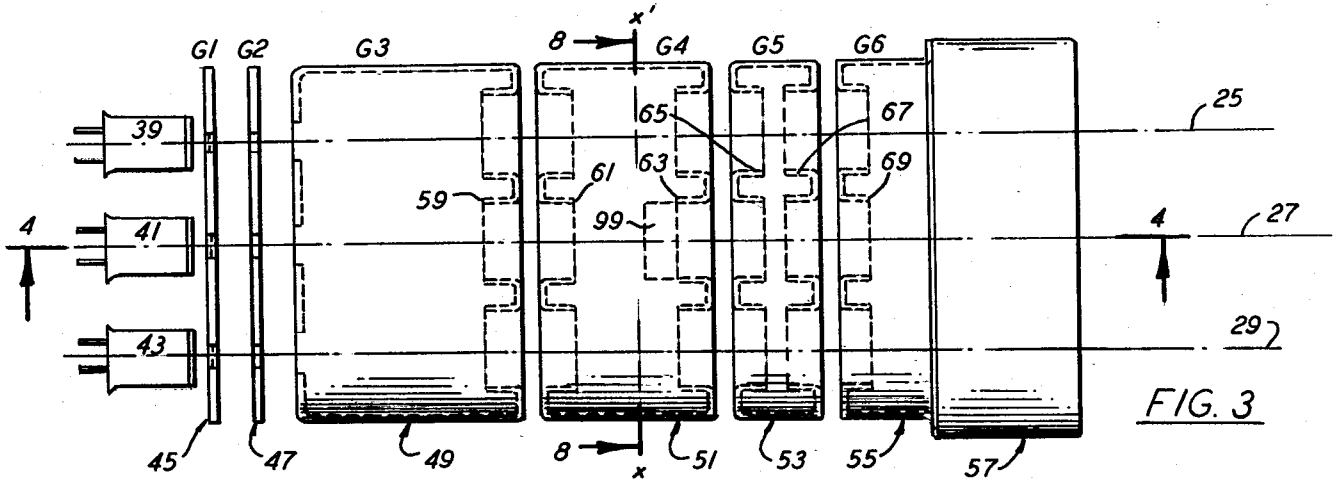
FIG. 3 is an illustration of a unitized tri-potential in-line plural beam electron gun assembly of the type utilized in FIG. 1.
Figure 4:
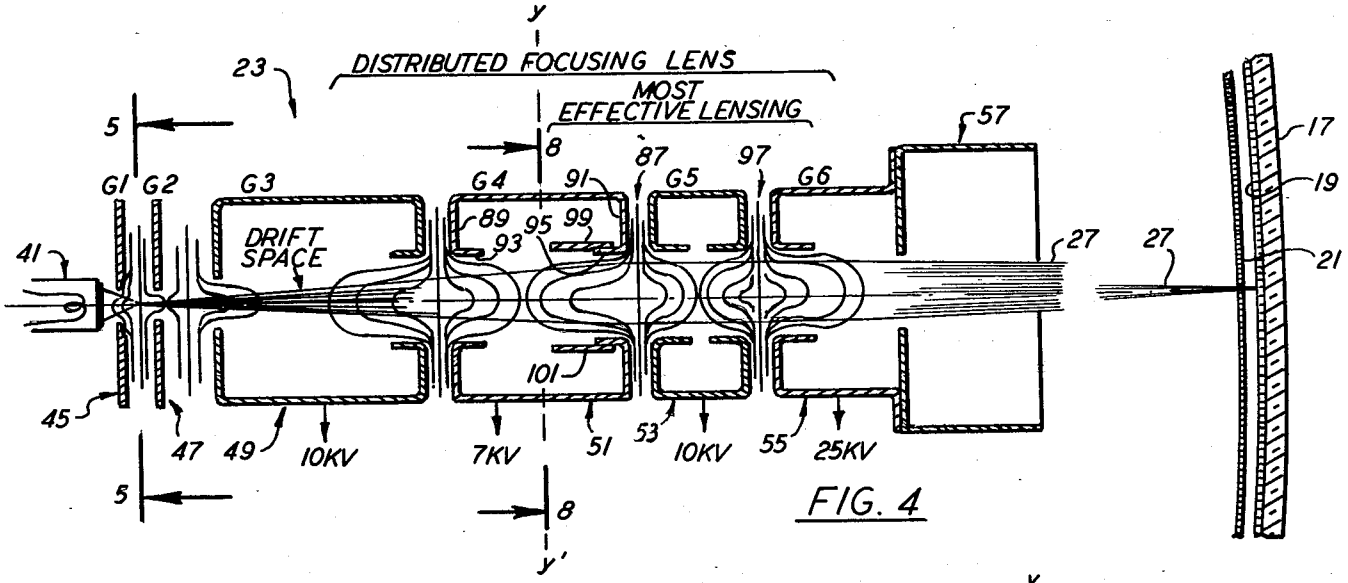
FIG. 4 is a sectional view of the center gun structure thereof taken along the line 4—4 in FIG. 3.

To fully understand the significance of the invention, attention is directed now to FIGS. 3 and 4 wherein structural aspects of the plural beam tri-potential in-line gun assembly 23 are illustrated in greater detail. The plural gun multi-electrode structure is unitized, in that, the in-line apertures for the three guns are contained in a common member for each of the respective electrode elements, as exemplarily phantomed in FIG. 3. Each of the respective in-line oriented beams 25, 27 and 29 traverses a substantially longitudinal arrangement of several functionally related electrode members. For example, sequentially positioned ahead of individual cathode elements 39, 41 and 43, is a unitized initial beam focusing electrode (G1) 45 (which incorporates discrete beam shaping characteristics, to be subsequently described), an initial beam accelerator electrode (G2) 47, a first high focusing electrode (G3) 49, a low focusing electrode (G4) 51, a second high focusing electrode (G5) 53, and a final accelerator electrode (G6) 55. Terminally positioned on the open forward portion of the final accelerator is a common plural apertured convergence cup member 57 wherein shunts and/or enhancers may be located in accordance with the known state of the art. The several unitized electrodes comprising the TPF in-line gun assembly 23 are conventionally positioned and held in spaced relationship with respect to one another by a plurality of rod-like insulative-supports, which for purposes of clarity are not shown.

The individually unitized G3, G4 and G5 focusing electrodes 49, 51 and 53 are formed as box-like structures of differing lengths. Each has definitive rear and forward substantially circular apertures therein which are often individually defined by peripherally inturned projections, such as for example, 59, 61, 63, 65, 67 and 69, as phantomed in FIG. 3.

For purposes of illustration, the center gun structure 57 of the unitized gun assembly 23 will be considered in greater detail, as the electron beam 27 emanating therefrom is more prone to exhibit a focused center-of-screen vertically oriented landing area, of undesired ovate shaping, such as shown in FIG. 2. In FIG. 3, beams 25, 27 and 29 are indicated as single simplistic lines, while in FIGS. 4 and 5 beam 27 is exemplarily illustrated as being a shaped beam comprised of a definitive bundle of moving rays of electrons.

Figure 5:
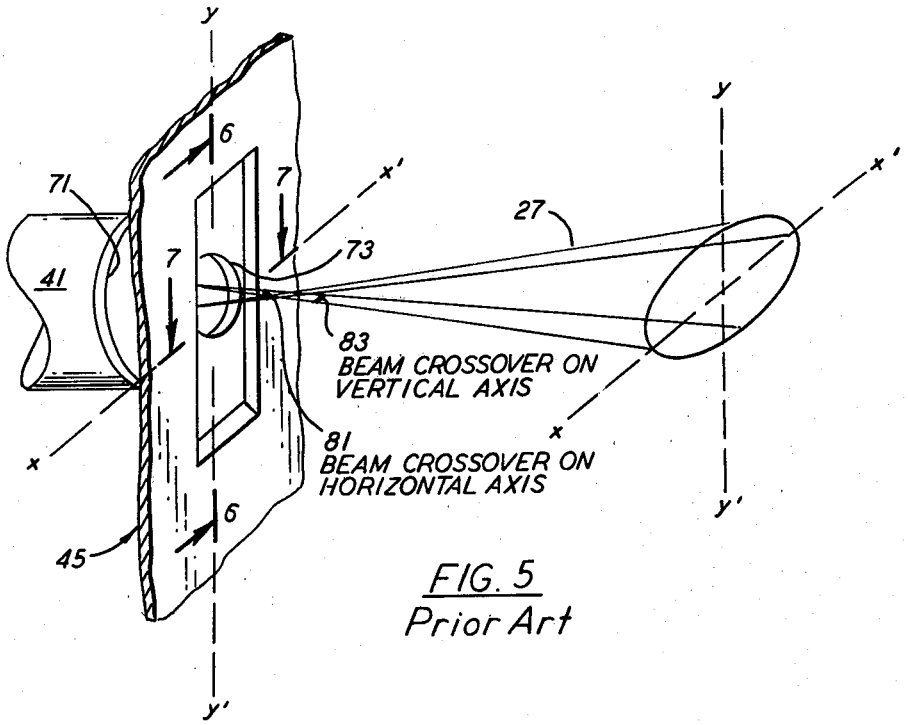
FIG. 5 Prior Art
FIG. 5 is a prior art perspective showing the beam shaping features of the beam forming electrode (G1), and the cross-sectional shaping of the beam resultant therefrom.
Figure 6:
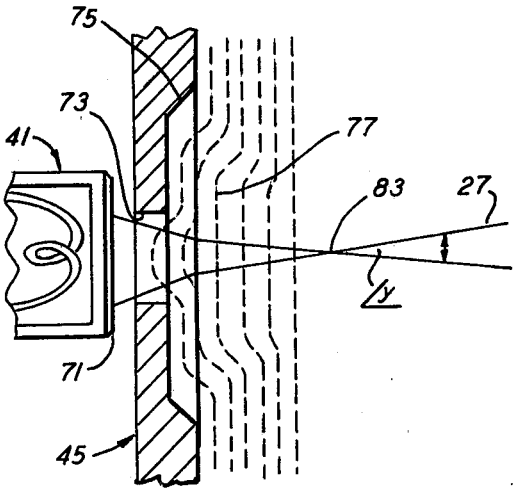
FIG. 6 Prior Art
FIGS. 6 and 7 are prior art sectional views of the beam forming electrode of FIG. 5, taken along the lines 6—6 and 7—7 therein, showing representative equipotential lines associated with the vertical and horizontal planes thereof.
Figure 7:
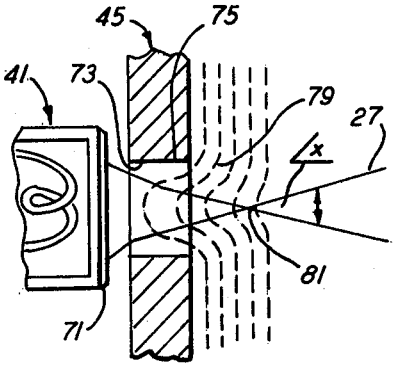
FIG. 7 Prior Art

The electrons comprising shaped beams 27, as depicted in FIGS. 4 through 7, enamate from the electron emissive material 71 on thermionic cathode 41, and thence traverse the aperture 73 in the initial beam forming electrode (G1) 45. Associated with this aperture is a discrete elongated beam shaping recessed configuration of indentation 75, having x and y coördinates. The major or "y" axis of the indentation is substantially coincident with the "y" axis of the gun structure 57. The configurative aperture-related area effects a lensing wherein the equipotential lines 77 and 79 are of differing field curvatures. In the region of the aperture, there is more field curvature in the horizontal (x-x') plane causing a crossover 81 close to the "G1" electrode 45. In contrast therewith, the lesser field curvature evidenced in the vertical (y-y') plane effects a crossover 83 further removed from the "G1" electrode. Thus, since the horizontal angle of emergence $<x$ is greater than the vertical angle of emergence $<y$, a rotation of the shaped beam 27 results, whereby the major cross-sectional dimension of the beam is oriented in the horizontal (x-x') plane, as shown in FIG. 5.

This shaped beam, of substantially oval cross-section, traverses the field of the initial beam accelerator electrode (G2) 47, and enters the first high focusing electrode (G3) 49, which is the first of the distributed focusing lens system indicated in FIG. 4. Since the potential applied to the "G3" electrode is greater than that applied to the low focusing electrode (G4) 51, a decelerating lensing field 85 is produced therebetween, wherein the ovately shaped beam 27 is somewhat slowed and continues expanding dimensionally. It is into these conditions that inherencies in the unitized construction are more likely to introduce asymmetrics into the lensing field.

The higher potential applied to the second high focusing electrode (G5) 53, effects an accelerating lensing field 87, which extends into the forward portion of the "G4" electrode, wherein the dimensional expansion of the shaped beam is arrested and increased speed applied thereto. The "G4" electrode 51 is formed to have sufficient length between the rear and forward portions 89 and 91, having respective apertures 93 and 95 therein, to adequately accommodate the influences of both the decelerating 85 and accelerating 87 fields therein.

It has been found that the forward portion of the "G4" electrode 51 is an expeditious location to introduce modifying means into the early stages of the most effective section of the TPF lensing, before the influences exerted by field 97 of the final accelerator electrode (G6) 55 become fully effective. Asymmetrics in a more rapidly moving beam are more difficult to correct. Thus, lensing of the horizontally oriented oval-shaped beam in the gun can be modified to overcome the aforedescribed focused center-of-screen abnormalities evidenced in FIG. 2.

The invention relates to means for achieving the desired circular center-of-screen beam spot landing. Such is successfully accomplished by introducing a modifying influence relative to the horizontal plane of the lensing field associated with the forward portion 91 of the "G4" electrode 51. This improvement is in the form of a pair of inserts of substantially planar metallic "sideboard" elements 99 and 101, positioned, as shown in FIGS. 3, 4, 8 and 9, within the low focusing electrode (G4). These are oriented in standing parallel relationship, one on either side of the forward aperture 95, in planes substantially coincidental with the horizontal (x'-x) plane 103 of the TPF gun assembly. As exemplarily shown, the sideboard elements are affixed to internal aperture projection 95. While the inward distance of projection or penetration "p" of these sideboard elements 99 and 101 from the interior surface of the forward end 91, is the controlling factor for determining the degree of field correction, it need not substantially exceed the diametrical dimension "d" of the related forward aperture 95. In a related manner, the length "k" of the respective sideboard elements need not substantially exceed the diametrical dimension "d" of the respective aperture.

Figure 9:
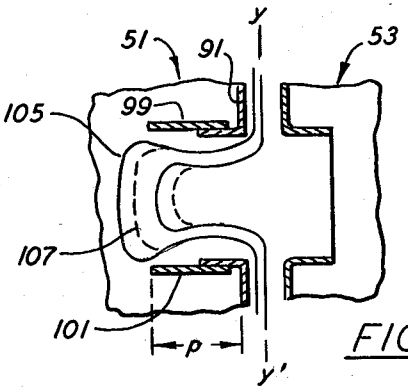
FIG. 9 is a sectional view showing correctional influences on the lensing field effected by the added sideboard elements to the forward aperture in the low focusing electrode (G4).
Figure 8:
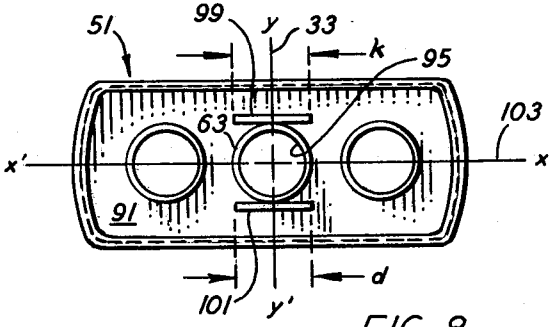
FIG. 8 is a plan view of the forward portion of the unitized low focusing electrode (G4) of the gun assembly, taken from the planes 8—8 in FIGS. 3 and 4.

The modifying influence of the sideboard elements on the field 87, within the "G4" electrode, is evidenced in FIG. 9, wherein the equipotential lines, in the vertical (y-y') plane of field 87, are changed from prior art shaping 105 to an improved correctional shaping 107. This lensing modification introduced into a critical stage of focusing, imparts the desired remedial influences to correct asymmetry and the disturbing aspects of spherical aberration in the focus lensing of the shaped beam. By this improvement, the equipotential lines in the accelerating field of the vertical plane are confined to a more curved shaping. This promotes more concentrated focusing in the vertical plane of the lensing, which in turn, affects the focused shaping of the beam causing the vertical axis of the focused spot to shrink. Thus, at the screen the horizontal and vertical dimensions of the spot are substantially equal, and a desired round spot landing results.

While the sideboard elements have been described as exemplarily utilized in the center gun structure of the tri-potential assembly 23, they are equally adaptable to usage in any or all of the in-line gun structures therein, if need for focusing correction of the respective shaped beams is evidenced.

INDUSTRIAL APPLICABILITY

The focusing improvement for discretely shaped beams in unitized in-line tri-potential electron gun structures, is a marked advancement overcoming focusing difficulties evidenced in the prior art. Employment of insertive sideboard elements with one or more of the forward apertures in the low focusing electrode (G4) portion of the distributed focusing lens, is both an expeditious and economical practice to effect improved center-of-screen focused beam landings. By this means, deleterious factors such as, constructional-induced asymmetrics often inherent in the lensing fields, and the subsequent spherical aberration affecting the shaped beams, are subjects of facile correction.

I claim:

1. A beam focusing improvement in a CRT plural beam tri-potential in-line electron gun assembly embodying a center and two side-related gun structures for use in a color tube having a forwardly positioned cathodoluminescent screen, each of said guns having individual coordinate beam path axes therethrough with the "x" axes thereof oriented in a common horizontal plane, said gun assembly being a construction of unitized in-line apertured electrode members sequentially positioned forward of individual electron producing cathode elements to provide for each gun an initial beam forming electrode (G1) embodying a discrete substantially elongated aperture-related beam shaping configuration therein whereof the major axis of said configuration is substantially coincident with the "y" axis of said gun structure, an initial beam accelerator electrode (G2), a first high focusing electrode (G3), a low focusing electrode (G4) having a longitudinal dimension defined between rear and forward apertured portions, a second high focusing electrode (G5), and a final accelerator electrode (G6), the "G3–G6" region forming a distributed focusing lens for said beam; said improvement relating to means for particularly modifying that portion of the beam lensing field associated with the forward end of said low focusing electrode (G4) of at least one of said gun structures in said assembly wherein the inherent substantially ovate cross-sectional shaping of the beam, having a major dimension substantially coincident with the "x" axis of said gun structure, is modified to provide a focused substantially circular beam spot at the center of said screen, said improvement comprising: a pair of substantially planar metallic sideboard elements oriented in standing parallel positions in a manner to project inwardly within said low focusing electrode (G4) and being substantially perpendicular to the interior surface of said forward end thereof, one of said sideboard elements being oriented on either side of the center forward aperture in planes substantially parallel with the "x" axis of said gun structure, said orientation effecting positional adjustment of the equipotential lines in the most effective "G4–G6" area of the distributed focusing lens formed spatially within the "G3–G6" region to provide substantially symmetrical lensing for focusing said respective electron beam.

2. The CRT shaped beam focusing improvement in a plural beam in-line tri-potential electron gun assembly according to claim 1 wherein the apertures of the electrodes comprising said distributed focusing lens are circular in shape and individually defined by peripherally in-turned projections, and wherein said sideboard elements are oriented as in-standing parallel extensions of at least one of said apertural projections in the forward portion of said low focusing (G4) electrode.

3. The CRT shaped beam focusing improvement in a plural beam in-line tri-potential electron gun assembly according to claim 1 wherein the inward distance of projection "p" of said sideboard elements from the interior surface of the forward end of said low focusing electrode (G4) need not substantially exceed the diametrical dimension "d" of the respective related "G4" forward aperture.

4. The CRT shaped beam focusing improvement in a plural beam in-line tri-potential electron gun assembly according to claim 1 wherein the length dimension "k" of said sideboard elements need not substantially exceed the diametrical dimension "d" of the respective related "G4" forward aperture.

5. The CRT shaped beam focusing improvement in a plural beam in-line tri-potential electron gun assembly according to claim 1 wherein said sideboard elements are substantially rectangular in shape.

* * * * *